US006763525B1

(12) United States Patent
Spector

(10) Patent No.: US 6,763,525 B1
(45) Date of Patent: Jul. 20, 2004

(54) THERAPEUTIC CLOTHING AND METHOD OF USE

(76) Inventor: Donald Spector, 380 Mountain Rd., Union City, NJ (US) 07087

( * ) Notice: Subject to any disclaimer, the term of this patent is extended or adjusted under 35 U.S.C. 154(b) by 0 days.

(21) Appl. No.: 10/266,494

(22) Filed: Oct. 8, 2002

(51) Int. Cl.[7] ..... A41D 13/00
(52) U.S. Cl. ..... 2/69; 601/134; 2/115
(58) Field of Search ..... 2/400, 403, 406, 2/408, 227, 228, 238, 113–115, 247–251, 69, 79, 80, 83, 85, 93, 94, 108, 102, 44, 92, 455, 243, 1, 171, 409, 158, 159, 160, 161.7, 161.8, 239; 450/1, 89; 601/134, 136, 138, 76, 84.8, 5.88, 148, 149, 151; 128/873, 874; 602/19; 606/201, 204; 600/9–15

(56) References Cited

U.S. PATENT DOCUMENTS 5,086,519 A * 2/1992 Rokasky ..... 2/408
5,381,558 A * 1/1995 Lo ..... 2/115
5,553,398 A * 9/1996 Schnewlin-Maier ..... 36/43
5,571,076 A * 11/1996 Cooper ..... 602/19
5,720,046 A * 2/1998 Lopez et al. ..... 2/159
5,806,093 A * 9/1998 Summers ..... 2/69
5,940,888 A * 8/1999 Sher ..... 2/267
5,950,239 A * 9/1999 Lopez ..... 2/115
5,978,965 A * 11/1999 Summers ..... 2/69
5,997,380 A * 12/1999 Yang ..... 450/57
6,138,281 A * 10/2000 Chiarutti ..... 2/239
6,258,020 B1 * 7/2001 Lopez ..... 600/15

* cited by examiner

*Primary Examiner*—Gloria M. Hale
(74) *Attorney, Agent, or Firm*—Collard & Roe, P.C.

(57) ABSTRACT

A therapeutic article of clothing is provided which is useful for the therapeutic application of pressure at certain pressure points throughout the human body. The clothing contains regions or pouches containing pellets at strategic locations which, when worn, aligns and centers the pouch over the pressure points where upon pin-point pressure can then be applied to the body by pressing on the pellet.

18 Claims, 3 Drawing Sheets

THERAPEUTIC CLOTHING AND METHOD OF USE

FIELD OF THE INVENTION

This invention relates in general to articles of clothing having one or more regions or area containing embedded pellets which, when the clothing is worn, centers the pellet over and in close proximity to known pressure points including those points wherein acupuncture is customarily applied. Discretely applying pressure to the pressure point by means of the pellet, provides certain therapeutic benefits.

Acupuncture is a well known practice of Chinese origin of puncturing the body with needles at specific points to relieve pain and effect the curing of certain diseases. The specific points, or acupoints, are well documented in the literature and known to practitioners in this art. Shiatsu is massage therapy applied with the fingers to those specific areas of the body used in acupuncture. Hence, when pressure is applied to shiatsu meridian lines on the human body, certain desirable benefits are obtained. The meridian are known as the pathway of life energy of the human body.

The present invention utilizes acupoints of oriental medical theory, the same acupoints to which acupuncture is applied. It is well known that there are acupoints located at specific positions of the human body and stimulations of a specific acupoint can result in medical benefits such as relieving pain, improved metabolism and improved health.

Over the past many centuries the benefits of acupressure and massage have been well documented. Massage as a form of therapy can be traced back to the ancient Greeks and Romans as an accepted form of medical treatment. One form of massage, acupressure has also been employed by the Chinese for over 5,000 years.

While the end result of acupressure and acupuncture are quite similar, they are different in that acupressure in its truest sense does not utilize needles. In either case it is believed that both systems stimulate the nervous system which releases neurohormones and affects the amounts of neurotransmitters. Moreover, both systems are effective for reducing muscle tension and pain, for at least some period of time. In addition to acupressure and acupuncture, the use of magnetism is also currently in vogue for the treatment of a variety of physical and other conditions.

More recently several methods and various kinds of apparatus have been proposed for applying pressure to the human body to provide relief from pain, stress and/or muscle tension. For example, U.S. Pat. No. 6,241,693 which issued Jun. 5, 2001 to Brian D. Lambden discloses a method and apparatus for applying pressure to the body of a person, particularly, those areas of the body which may be difficult to reach. The apparatus disclosed in this invention is comprised of an arcuate shaft, a handle that extends from the arcuate shaft in a plane intersecting the plane of the arcuate shaft, and a pressure applicator movably attached to the arcuate shaft for applying pressure to the body. The apparatus is used for massaging or for applying acupressure.

A magnetic acupuncture device which is adapted as a substitute for the conventional acupuncture needle is disclosed in U.S. Pat. No. 6,113,530 which issued to Nai-Hsin Chien on Sep. 5, 2000. The device is in the form of a magnetic acupuncture pen which has a head providing an acupuncture point adapted to massage and press on a specific acupoint on a human body to provide stimulations.

U.S. Pat. No. 6,299,586 which issued Oct. 9, 2001, to Thauh D. Cao, discloses an acupressure point treatment apparatus which includes a pellet on a finger strap. The strap includes a band extending around a finger and a rigid extension containing a pellet perpendicular to the axis of the finger tip of an acupressurist for performing acupressure treatment. The patent also discloses a galvanic skin response monitor electronically connected to the pellet. In one embodiment, the pellet can be made of silver or a magnetized material to provide an effect of magnetic therapy.

Therapeutic clothing has been described in U.S. Pat. No. 5,950,239, which issued Sep. 14, 1999 to Richard Lopez and contains a permanent magnet whereby the polarity is directed to selected locations of the body to assist in healing. The magnetic magnets are thin members and are positioned to contact the skin of the user. The magnets can be contained in various articles of clothing such as shirts, gloves, trousers, socks, brassieres, knee pads, and the like.

In U.S. Pat. No. 6,261,306, which issued Jul. 17, 2001 to George Henry Kramer, an acupressure treatment device is disclosed for use on a selected skin surface portion of a human body. The device which can be in the form of a patch is made of a thin flexible sheet having a first side, a second side and a margin, wherein the margin is shaped to correspond to a selected skin surface portions for properly orienting the device. The first side contains an adhesive layer for attachment to the skin. At least one bead is located on the adhesive layer suitable for positioning the bead against the skin to provide acupressure to at least a portion of the body surfaces. In this device the patch with bead adheres to the skin until removal. Additionally, each time the path is replaced, it must be positioned for proper orientation over the acupoint.

However, prior to the present invention the application of acupressure, and particularly acupuncture, was usually done by a professional person at specific locations, such as a doctor's office, health club, or similar location. A person seeking benefit of such therapy such as acupuncture usually found difficulties in attempting to treat him or herself.

Accordingly, one or more of the following objects will be achieved by the practice of this invention. It is an object of this invention to provide a method whereby a person seeking the benefit of acupressure, can him or herself apply such pressure to known pressure points on his or her own body with essentially complete discretion and for the most part, without another person being aware of such action. It is a further object of the invention to provide articles of clothing whereby a person can discretely apply pressure through such clothing to predetermined acupoints on one's body. Another object is to provide clothing which is custom tailored to have one or more regions or pouches incorporated into such clothing and when the clothing is worn, the region or pouch is located over one or more acupressure points on the wearer's body. A still further object is to provide customized clothing where the pouches contain pellets through which pressure can be applied by the wearer to certain pressure points resulting in a therapeutic benefit. Another object of the present invention is to provide clothing with pouches or regions which contain pellets which can be magnetized. There are other objects that will become readily apparent to the one skilled in the art in light of the teachings herein set forth.

SUMMARY OF THE INVENTION

In its broad aspects, the present invention is directed to method for applying acupressure to an acupoint on a human being and to articles of clothing having (a) at least one region or pouch thereon of a size and shape which, when worn by a person, will center the region or pouch and its contents over and in-close proximity to a specific known pressure point on the body of the person wearing said clothing, and (b) contained in said pouch or located at such region at least one pellet of spherical or elliptical configurations, whereupon pressuring the pellet against the body of the person wearing the clothing, experts pin-point pressuring at the site of a known pressure point, providing at least some therapeutic benefit to said person. If desired, the pellet can be magnetized to obtain additional benefits.

DESCRIPTION OF THE PREFERRED EMBODIMENTS

Although many of the known methods used for acupressure apply pressure over a wide area of the body without limiting the pressure to specific pressure points, the present inventions is useful for pin-pointing applications of pressure just to those pressure points which are known to cause specific forms of relief. Accordingly, the present invention in its application is more like acupuncture than a massage since pressure is concentrated at specific points. Moreover, the pressure is concentrated to an even smaller area since it is transmitted through a spherical or elliptical pellet where the surface area to which pressure is applied is very small.

Figure 1:
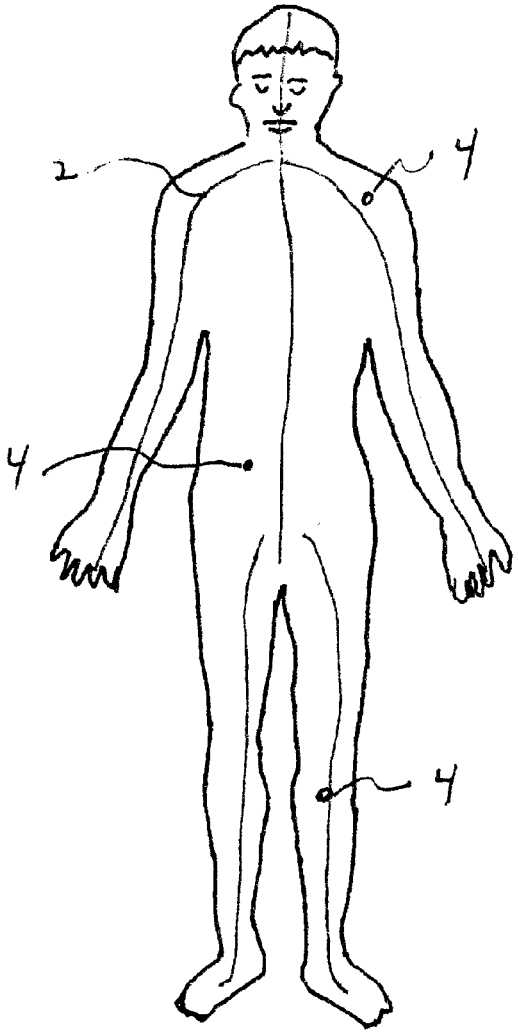
FIG. 1 and FIG. 2 depict the front and back view of a human body showing meridian lines and a few acupoints.
Figure 2:
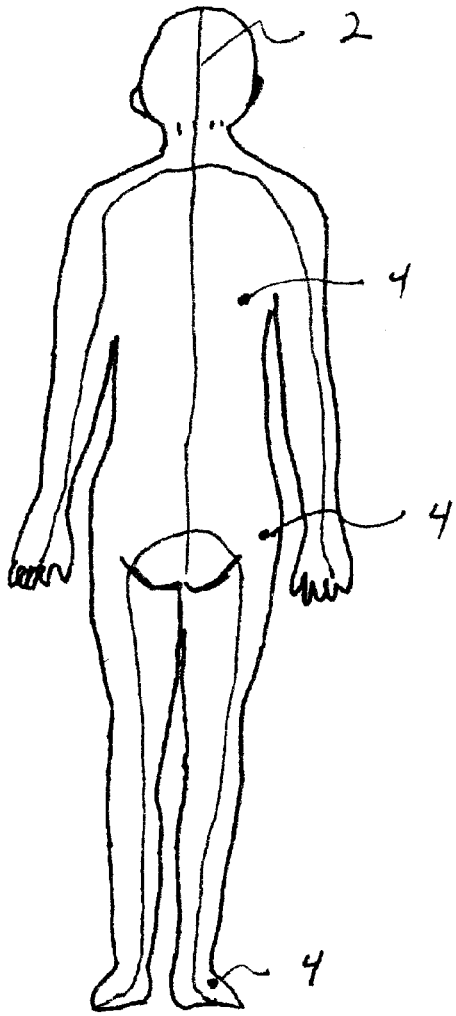

With respect to the drawings FIG. 1 and FIG. 2 are front and back views of human body showing meridian lines (2) and some shiatsu body points (4). It is understood that the specific location of acupoints on a person will, of course, vary from person to person, and hence the drawings are illustrative and only depicts a few acupoints.

Figure 3:
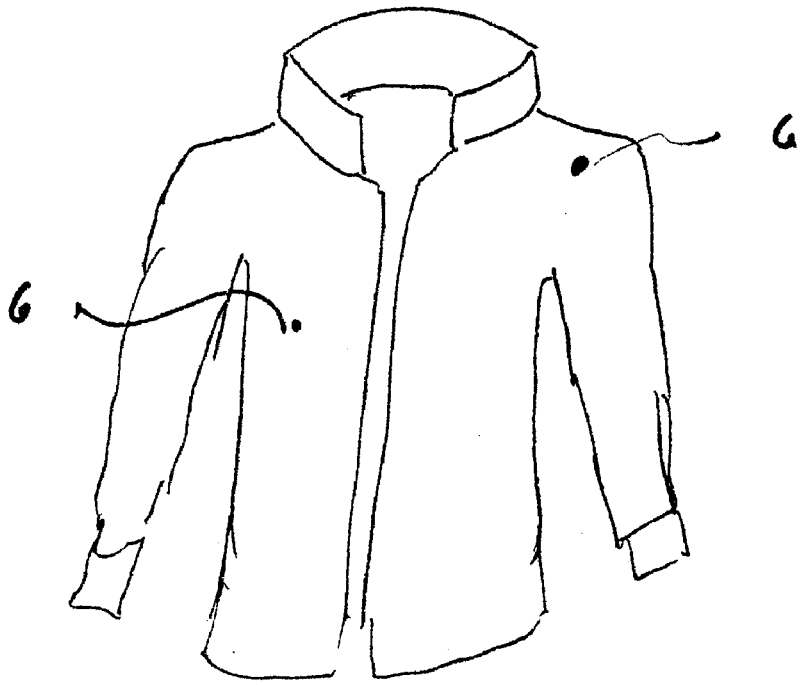
FIG. 3 is a view of a shirt.
Figure 4:
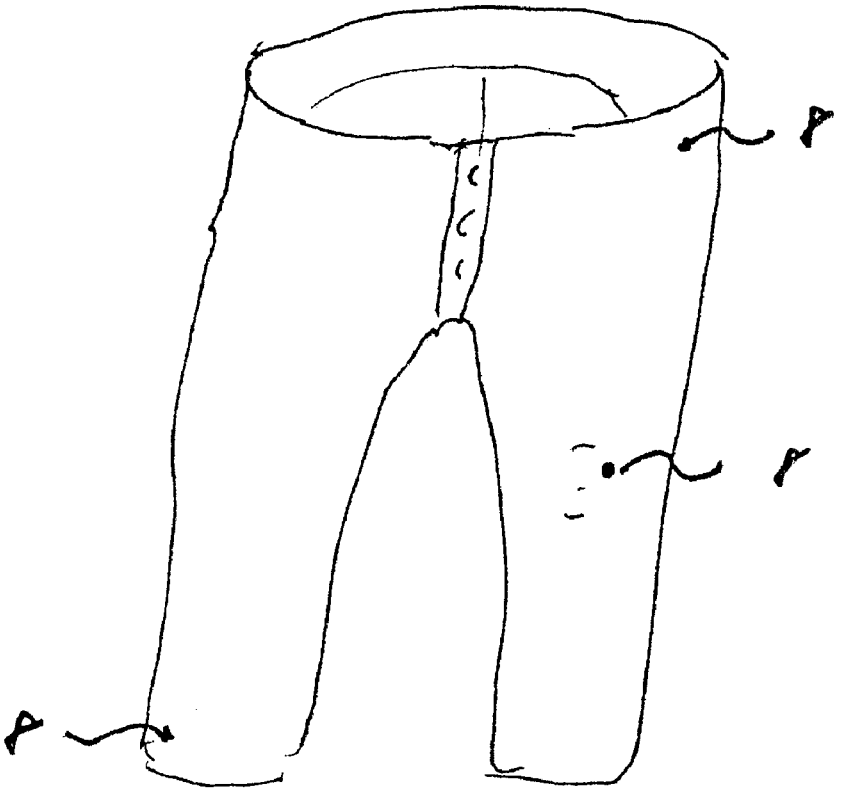
FIG. 4 is a view of a pair of trouser.

FIG. 3 and FIG. 4 merely show a shirt and trousers and point out acupoint (6) and (8) as typical locations on the garments wherein the pellets might be positioned.

Figure 5:
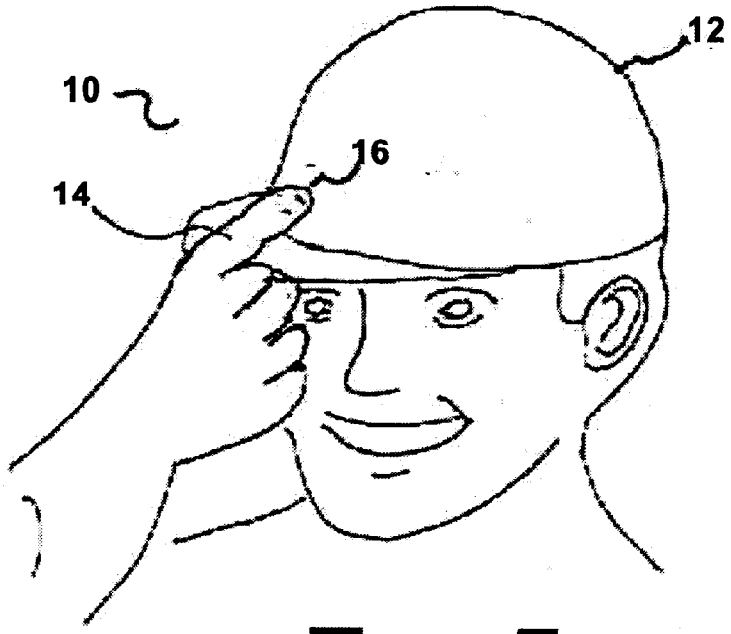
FIG. 5 is a view of a person wearing a baseball cap and who is applying pressure at an acupoint on his forehead by pressing on pellet embedded in the cap.

FIG. 5 depicts an individual (10) wearing a cap (12) and pressing with a finger (14) on the exterior of the cap at acupoint (16) so that pressure is exerted through a pellet, (not shown), embedded in the cap material to the underlying acupoint.

Figure 6:
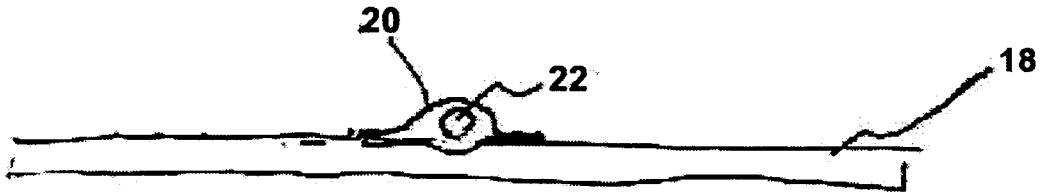
FIG. 6 is a cross-sectional view of a garment showing a pouch and a pellet contained therein.

FIG. 6 in a cross-sectional view of a portion of a garment (18) showing a pouch (20) sewn into the garment and containing pellet (22).

The acupoints on the body at which acupressure is applied on well known points throughout the human body and are those where acupuncture needles are usually inserted. For example, U.S. Pat. No. 5,950,239 discloses in FIG. 1 and FIG. 2 the frontal and backside views of a human body showing meridian lines and shiatsu body points.

U.S. Pat. No. 6,299,586 indicates in a discussion of background art that acupuncture and acupressure points can be located with a point locator which includes a low-current galvanometer, which is commonly known to acupuncturist or a Galvanic Skin Response Monitor or to bio-feedback therapists, as a Skin Conductor Monitor. The treatment point is located in the region where electrical resistance of the skin in relatively lower than that of the surrounding tissues. Accordingly, for any one individual the exact location of acupoints on such persons body can easily be determined.

As noted above, the present invention is directed to articles of clothing which may be custom made, or altered after being made, and contain pellets positioned on the garment which when worn locate the pellets over acupoints whereupon pressure can be applied by the wearer to the pellet and at the acupoint.

The types of clothing which can be employed in the present invention, covers a wide variety of styles, fabrics and designs. The main characteristic is that the clothing be tailored such that when it is worn, the pouch or the area in which the pellet is embedded is in alignment with the pressure point and when pressure is applied to the pellet, it is at the proper locations to be in alignment with the known pressure point.

Hence, the term "clothing" as used herein is intended to cover most any article of clothing which a person can wear and which covers one or more acupressure points on the human body. Illustrative articles of clothing include but are not limited to, dress shirts, gloves, trousers, socks, suits, brassieres, caps, skirts, T-shirts, briefs, boxer shorts, belts, blouses, sport shirts, bathing suits, jackets, coats, and the like.

The term "customized clothing" as used throughout the specification and claims is intended to cover clothing which has one or more regions or pouches included in the clothing when it is made. It also is intended to include clothing which has pouches or other means added to, or affixed on, the clothing after it has been fabricated to contain the pellets.

The only limitation on the type of clothing that can be customized to have the pellet-containing pouch is the location of the pressure points on the human body. For example, if the pressure points are on the head, appropriate clothing can include caps, hats, hoods, sweat bands, and the like. If the pressure point is on the neck or shoulder, the pellets can be located in the collar or back, side or front of the shoulder area of a sport or dress shirt or a turtle-neck shirt.

The pouch itself can be in the form of a pocket, bag, sack etc., or even a small pocket within a large pocket for retention of the pellet. Hence, the pouch should be small enough so that the pellet is confined to a specific area of the clothing, yet of such configuration so that the pellet can be removed if desired when the clothing is washed or dry-cleaned. Openings in the pouch can be sealable after removal and/or replacement of the pellet such as by VELCRO® (hook and loop) fasteners or other means. If the clothing is of such form, or if the pellet is small enough so that removal is not necessary, the pellet can be permanently embedded in the clothing fabric.

At the time the clothing is made, such as a custom made suit, the fabric can be sewn to incorporate the pellets at specific locations within the fabric layers. Although the pellets could be permanently sewn into the clothing, for practical purpose, such as pressing, it is desirable to have means for removing and replacing the pellets. For example, VELCRO® (hook and lop) fasteners should be used to seal and unseal a small pouch possibly in the lining of the clothing. In the event that it is desired to attach a pellet to ready made clothing, this can be done by also attaching a small pouch with the pellet by several means such as VELCRO® (hook and loop) strips.

The term "pellet" as used throughout the specification and appended claims is intended to encompass metal or non-metal (plastic, marble, etc.) items which are substantially in the shape of a ball, sphere, spherical, bead, shot, marble, plea, pebble, seed and the like. Excluded are objects which have large flat surfaces. The shape of the pellet should be such that when pressed against the body, pressure is exerted in a very localized area, i.e., a pin-point, as would be done by an acupuncture needle. Hence, the curvature of the pellet is important so that a minimum of surface area touches the body for a maximum of applied pressure.

The pellets themselves can be made of a variety of metals, plastics, ceramics or even in some cases wood. For practice, however, it is preferred that the pellet be metal, preferably spherical in shape, and made of steel, iron, a metal alloy, nickel, silver, and the like. The pellet can also be glass, ceramic, marble, plastic and the like. If made of wood, it should be a hard wood such as maple, and preferably spherical in shape.

The size of the pellet will largely be determined by the clothing in which it is embedded as well as the location of the acupressure point. Pellets of three-eighths to one quarter inch or less in diameter would not be conspicuous or show through the clothing and yet be large enough when pressed to apply the necessary pressure to the acupoint. Of course, larger pellets or pellets of elliptical shape can be used if desired even those of one-half inch in diameter or larger.

The present invention differs from known wrist bands which had been available in the past, since the pressure inducing means on such bands were not embedded or concealed in a band and usually were button shaped whereby pressure was not concentrated or pin-pointed to a very specific area. Moreover, as long as the wrist band was worn, pressure was being applied.

An advantage of the present invention is that the person wearing the therapeutic clothing can apply pressure to one or more acupoints on his or her body even in public without anyone else being aware of what is happening. It can be done very discretely and no one would know that a person is receiving acupressure treatment by simply pressing on a certain area of a cap, shirt, trouser or other garment. The person need only feel through the clothing until the pellet is touched and then press the pellet to the skin for whatever period is necessary to achieve at least some of the desired results.

In a further embodiment of the present invention, it has been found that additional therapeutic benefits can be obtained if the pellet which is embedded in the clothing has been magnetized so as to provide additional benefit to the person wearing the clothes.

Although the invention has been illustrated by the preceding description, it is not to be construed as being limited to the materials disclosed herein, the invention is directed to the generic areas as herein before disclosed. Various modifications and embodiments thereof can be made without departing from the spirit and scope thereof.

What is claimed is:

1. A therapeutic article of clothing comprising:

(a) at least one area of said clothing which, when said clothing is worn by a person, will discretely center the area over a specific known acupoint on the body of said person, and (b) embedded in said area of said clothing at least one hard pellet configured such that whereupon the person's pressing the pellet against the body the person wearing the clothing exerts pin-point pressure substantially equaling that of acupuncture to the acupoint, providing at least some therapeutic benefit to said person.

2. The therapeutic clothing of claim 1 which is an undergarment.

3. The therapeutic clothing of claim 1 which is a cap.

4. The therapeutic clothing of claim 1 which is a shirt.

5. The therapeutic clothing of claim 1 which is a pair of trousers.

6. The therapeutic clothing of claim 1 which is a pair of gloves.

7. The therapeutic clothing of claim 1 which is a pair of stockings.

8. The therapeutic clothing of claim 1 wherein the embedded pellet is embedded in the fabric.

9. The therapeutic clothing of claim 1 wherein the pellet is of spherical shape.

10. The therapeutic clothing of claim 1 wherein the pellet is of elliptical shape.

11. The therapeutic clothing of claim 9 wherein the pellet is a metal selected from the group consisting of steel, iron, nickel, silver and an alloy.

12. The therapeutic clothing of claim 9 wherein the pellet is a non-metal selected from the group consisting of glass, ceramic, marble, and wood.

13. The therapeutic clothing of claim 9 wherein the pellet is a magnetized metal.

14. The therapeutic clothing of claim 1 wherein the pellet is permanently embedded in said clothing.

15. The therapeutic clothing of claim 1 having means wherein the pellet can be removed and replaced from the clothing when desired.

16. The therapeutic clothing of claim 15 wherein the pellet is contained in a pouch which can be opened and closed.

17. The therapeutic clothing of claim 15 wherein the pellet is adhesively attached to the inner side of clothing.

18. A method of increasing the feeling and well-being of a person wearing the therapeutic clothing of claim 1, which comprises said person applying pressure to an acupoint on the person's body by pressing on said pellet positioned over said acupoint in a manner substantially equaling the application of acupuncture to the acupoint for a period of time to effect said feeling.

* * * * *